US006405712B1

(12) United States Patent
Nomura

(10) Patent No.: US 6,405,712 B1
(45) Date of Patent: Jun. 18, 2002

(54) FUEL DISTRIBUTION PIPE IN FUEL INJECTION APPARATUS

(75) Inventor: Kenichi Nomura, Yokohama (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 09/698,331

(22) Filed: Oct. 27, 2000

(30) Foreign Application Priority Data

Mar. 12, 1999 (JP) ..... 1999-344113

(51) Int. Cl.[7] ..... F02M 41/00
(52) U.S. Cl. ..... 123/456; 123/541; 123/41.31
(58) Field of Search ..... 123/456, 41.31, 123/541, 514, 468, 469

(56) References Cited

U.S. PATENT DOCUMENTS 4,491,117 A * 1/1985 Koide ..... 123/541
4,922,958 A * 5/1990 Lemp ..... 137/561 A
5,156,134 A * 10/1992 Tochizawa ..... 123/541
5,291,869 A * 3/1994 Bennett ..... 123/527
5,595,160 A * 1/1997 Matsumoto et al. ..... 123/456
5,803,051 A * 9/1998 Stehr ..... 123/456
5,832,903 A * 11/1998 White et al. ..... 123/514
5,964,206 A * 10/1999 White et al. ..... 123/541
5,975,032 A * 11/1999 Iwata ..... 123/41.31

* cited by examiner

*Primary Examiner*—Carl S. Miller
(74) *Attorney, Agent, or Firm*—Zito & Grandinetti; Joseph J. Zito; Kendal M. Sheets

(57) ABSTRACT

The invention provides a fuel distribution pipe which can restrict an increase of temperature of a fuel flowing within a fuel distribution path of the fuel distribution pipe, whereby it is possible to improve an operation property of the engine. In the fuel distribution pipe, the fuel distribution path is pierced along a line X—X in a direction of a longitudinal axis of the fuel distribution pipe and an injection valve supporting hole for inserting and supporting a rear end portion of the fuel injection valve and a fuel introduction path for supplying a fuel having a pressure increased by a fuel pump are continuously provided in the fuel distribution path of the fuel distribution pipe, and a cooling water flow path extending along the line X—X in the direction of the longitudinal axis of the fuel distribution path and sectioned from the fuel distribution path is provided on an outer periphery of the fuel distribution path, thereby introducing a cooling water into the cooling water flow path.

9 Claims, 10 Drawing Sheets

FUEL DISTRIBUTION PIPE IN FUEL INJECTION APPARATUS

BACKGROUND OF THE INVENTION

1. Technical Field

The present invention relates to a fuel injection apparatus which increases a pressure of a fuel within a fuel source by a fuel pump so as to supply the fuel into the fuel distribution path of a fuel distribution pipe and injects and supplies a fuel controlled by a fuel injection valve mounted to the fuel distribution pipe toward an engine, and more particularly to a fuel distribution pipe provided with a fuel distribution path.

2. Description of the Prior Art

A fuel distribution path is pierced in a fuel distribution pipe in a longitudinal axial direction.

A fuel introduction path is connected and opened to the fuel distribution path, an injection valve supporting hole is opened to the fuel distribution path, a pressure of a fuel within a fuel source is increased and the fuel is supplied to the fuel introduction path by a fuel pump, and a rear end portion of a fuel injection valve for injecting and supplying the fuel is pressed into and supported to the injection valve supporting hole. Accordingly, the pressure of the fuel within the fuel source is increased by the fuel pump, and the fuel having the increased pressure is supplied into the fuel distribution path of the fuel distribution pipe via the fuel introduction path.

On the other hand, the fuel injection valve is structured such as to perform a fuel injection on the basis of an injection signal output from an electronic control unit (ECU), and the fuel having the increased pressure within the fuel distribution path is injected to an engine or an intake pipe or the like connected to the engine via the fuel injection valve.

In accordance with the conventional fuel injection apparatus mentioned above, a temperature of the fuel within the fuel distribution path of the fuel distribution pipe tends to be increased, and this is caused by the following reasons.

Firstly, it is because the fuel introduction path connecting the fuel pump to the fuel distribution path is heated and the fuel having an increased temperature is easily supplied into the fuel distribution path.

That is, the fuel introduction path is structured such as to be piped around within an engine room in which an atmospheric temperature is largely increased, whereby the fuel introduction path is heated by a heat within the engine room and the fuel flowing therein is heated so as to increase the temperature thereof.

Secondly, it is because the fuel distribution pipe is directly heated.

That is, the fuel distribution pipe is structured such as to be disposed within the engine room and arranged significantly near the engine, whereby the temperature is easily increased particularly due to an influence of heat generated at a time of operating the engine, so that the fuel within the fuel distribution pipe is directly heated.

Accordingly, when the temperature of the fuel within the fuel distribution path of the fuel distribution pipe is increased due to the causes mentioned above, vapors are generated in the fuel flowing within the fuel distribution path, so that when the vapors are supplied to the engine in a state of being contained in the fuel injected from the fuel injection valve, there is a risk of damaging a good operation property of the engine.

That is, when the fuel containing the vapors is supplied, the fuel is intermittently supplied and the fuel can not be continuously and stably supplied. Further, since an amount of fuel actually supplied is reduced in correspondence to an amount of the vapors, it is impossible to stably and accurately supply the fuel.

SUMMARY OF THE INVENTION

The present invention is made by taking the problems mentioned above into consideration, and a first object of the present invention is to provide a fuel distribution pipe which can restrict an increase of temperature of a fuel flowing within a fuel distribution path of a fuel distribution pipe so as to continuously supply the fuel stably and accurately to an engine, whereby it is possible to improve an operation property of the engine.

Further, a second object of the present invention is to prevent a sound caused by a pressure change of a fuel within a fuel distribution path generated by an opening and closing operation of a fuel injection valve from being transmitted to the outside.

In order to achieve the objects mentioned above, in accordance with a first aspect of the present invention, there is provided a fuel distribution pipe in a fuel injection apparatus structured such as to increase a pressure of a fuel within a fuel source by a fuel pump so as to supply to the fuel distribution pipe and inject and supply the fuel to an engine via a fuel injection valve attached to the fuel distribution pipe, in which the fuel distribution path is pierced along a line X—X in a direction of a longitudinal of the fuel distribution pipe and an injection valve supporting hole for inserting and supporting a rear end portion of the fuel injection valve and a fuel introduction path for supplying a fuel having a pressure increased by a fuel pump are continuously provided in the fuel distribution path of the fuel distribution pipe, and in which a cooling water flow path extending along the line X—X in the direction of the longitudinal axis of the fuel distribution path and sectioned from the fuel distribution path is provided on an outer periphery of the fuel distribution path, thereby introducing a cooling water into the cooling water flow path.

Further, in accordance with a second aspect of the present invention, there is provided a fuel distribution pipe in a fuel injection apparatus as recited in the first aspect, wherein a cooling water introduction path and a cooling water discharge path are opened to the cooling water flow path, thereby circulating the cooling water within the cooling water flow path.

Further, in accordance with a third aspect of the present invention, there is provided a fuel distribution pipe in a fuel injection apparatus as recited in the first aspect, wherein the fuel distribution path and the cooling water flow path are formed within the fuel distribution pipe in a sectional manner by forming the fuel distribution path and the cooling water flow path formed in the fuel distribution pipe so as to be opened in one end portion by a casting process, and closing the one end portion by one side closing member, and the fuel introduction path connected to the fuel distribution path and a cooling water introduction path connected to the cooling water flow path are provided in the one side closing member.

Further, in accordance with a fourth aspect of the present invention, there is provided a fuel distribution pipe in a fuel injection apparatus as recited in the third aspect, wherein the fuel introduction path connected to the fuel distribution path, the cooling water introduction path connected to the cooling water flow path and a cooling water discharge path are provided in the one side closing member.

Further, in accordance with a fifth aspect of the present invention, there is provided a fuel distribution pipe in a fuel injection apparatus as recited in the first aspect, wherein the fuel distribution path disposed along the line X—X in the direction of the longitudinal axis within the fuel distribution pipe is formed so as to be sectioned from the cooling water flow path by forming the fuel distribution path and the cooling water flow path in the fuel distribution pipe by a drawing process along the line X—X in the direction of the longitudinal axis and closing the fuel distribution path and the cooling water flow path respectively open to one end portion and another end portion of the fuel distribution pipe by one side closing member and another side closing member.

Further, in accordance with a sixth aspect of the present invention, there is provided a fuel distribution pipe in a fuel injection apparatus as recited in the fifth aspect, wherein the fuel introduction path connected to the fuel distribution path and the cooling water introduction path connected to the cooling water flow path are provided in the one side closing member.

Further, in accordance with a seventh aspect of the present invention, there is provided a fuel distribution pipe in a fuel injection apparatus as recited in the fifth aspect, wherein the fuel introduction path connected to the fuel distribution path and the cooling water introduction path and the cooling water discharge path connected to the cooling water flow path are provided in the one side closing member.

Further, in accordance with an eighth aspect of the present invention, there is provided a fuel distribution pipe in a fuel injection apparatus as recited in the fifth aspect, wherein the fuel introduction path connected to the fuel distribution path and the cooling water introduction path connected to the cooling water flow path are provided in the one side closing member, and the cooling water discharge path connected to the cooling water flow path is provided in the another side closing member.

Further, in accordance with a ninth aspect of the present invention, there is provided a fuel distribution pipe in a fuel injection apparatus as recited in the first aspect, wherein heat radiating fins disposed along the line X—X in the direction of the longitudinal axis of the fuel distribution pipe are provided in any one or both of an outer peripheral wall of the fuel distribution path and an inner peripheral wall of the cooling water flow path.

Further, in accordance with a tenth aspect of the present invention, there is provided a fuel distribution pipe in a fuel injection apparatus as recited in the first aspect, wherein the cooling water flow path is sectioned into a first cooling water flow path and a second cooling water flow path along the line X—X in the direction of the longitudinal axis by a partition wall, the first cooling water flow path and the second cooling water flow path are communicated by another end portion of the fuel distribution pipe, the cooling water introduction path is opened to the first cooling water flow path open to the one end portion, and the cooling water discharge path is opened to the second cooling water flow path open to the one end portion.

In accordance with the first aspect mentioned above, the fuel within the fuel distribution path of the fuel distribution pipe is cooled by the cooling water within the cooling water flow path provided in the outer periphery of the fuel distribution path, and when the heat within the engine room is applied to the fuel distribution pipe, the heat is cooled by the cooling water within the cooling water flow path so as to be prevented from being transmitted, thereby preventing the temperature of the fuel flowing within the fuel distribution path from being increased.

In accordance with the second aspect, since the cooling water within the cooling water flow path flows into from the cooling water introduction path and is discharged from the cooling water discharge path after flowing within the cooling water flow path so as to circulate within the cooling water flow path, it is possible to increase a cooling effect of the fuel within the fuel distribution path.

In accordance with the third aspect, the fuel distribution pipe is formed by a casting process, the opening of the one end portion of the fuel distribution pipe is closed by the one side closing member, and the inner portion of the fuel distribution pipe is sectioned into the fuel distribution path and the cooling water flow path. Further, since the fuel introduction path and the cooling water introduction path are provided in the one side closing member, it is possible to easily form the flow paths.

In accordance with the fourth aspect, since the fuel introduction path, the cooling water introduction path and the cooling water discharge path are provided in the one side closing member, it is possible to circulate the cooling water within the cooling water flow path by a simple structure, and it is possible to increase a cooling effect.

In accordance with the fifth aspect, the fuel distribution pipe is formed of the drawn material and the openings at both ends thereof are closed by the one side closing member and the another side closing member, thereby forming the fuel distribution pipe provided with the fuel distribution path and the cooling water flow path sectioned from each other, so that it is possible to reduce the manufacturing cost.

In accordance with the sixth aspect, since the fuel introduction path and the cooling water introduction path are provided in the one side closing member in the fuel distribution pipe made of the drawn material, it is possible to easily form the flow paths.

In accordance with the seventh aspect, since the fuel introduction path, the cooling water introduction path and the cooling water discharge path are provided in the one side closing member in the fuel distribution pipe made of the drawn material, it is possible to circulate the cooling water within the cooling water flow path in accordance with a simple structure, and it is possible to increase a cooling effect.

In accordance with the eighth aspect, in the fuel distribution pipe made of the drawn material, since the fuel introduction path and the cooling water introduction path are provided in the one side closing member and the cooling water discharge path is provided in the another side closing member, it is possible to securely circulate the cooling water within the cooling water path, so that it is possible to further improve a cooling property of the fuel within the fuel distribution path.

In accordance with the ninth aspect, since the heat radiating area is increased by the heat radiating fin, it is possible to increase a heat radiating property with respect to the cooling water and it is possible to further effectively restrict an increase of temperature of the fuel flowing within the fuel distribution path.

In accordance with the tenth aspect, the cooling water path is sectioned into the first cooling water path and the second cooling water path by the partition wall, and the paths are connected at the another end and are respectively sectioned at the one end and opened.

Since the cooling water flows downstream through the first cooling water path and thereafter U-turns toward and flows through the second cooling water path, it is possible to largely improve the cooling effect of the fuel within the fuel distribution path. Further, it is possible to improve a rigidity of the fuel distribution pipe by the partition wall.

DESCRIPTION OF THE PREFERRED EMBODIMENTS

A description will be given below of an embodiment of a fuel distribution pipe in a fuel injection apparatus in accordance with the present invention with reference to FIGS. 1 to 3.

Figure 1:
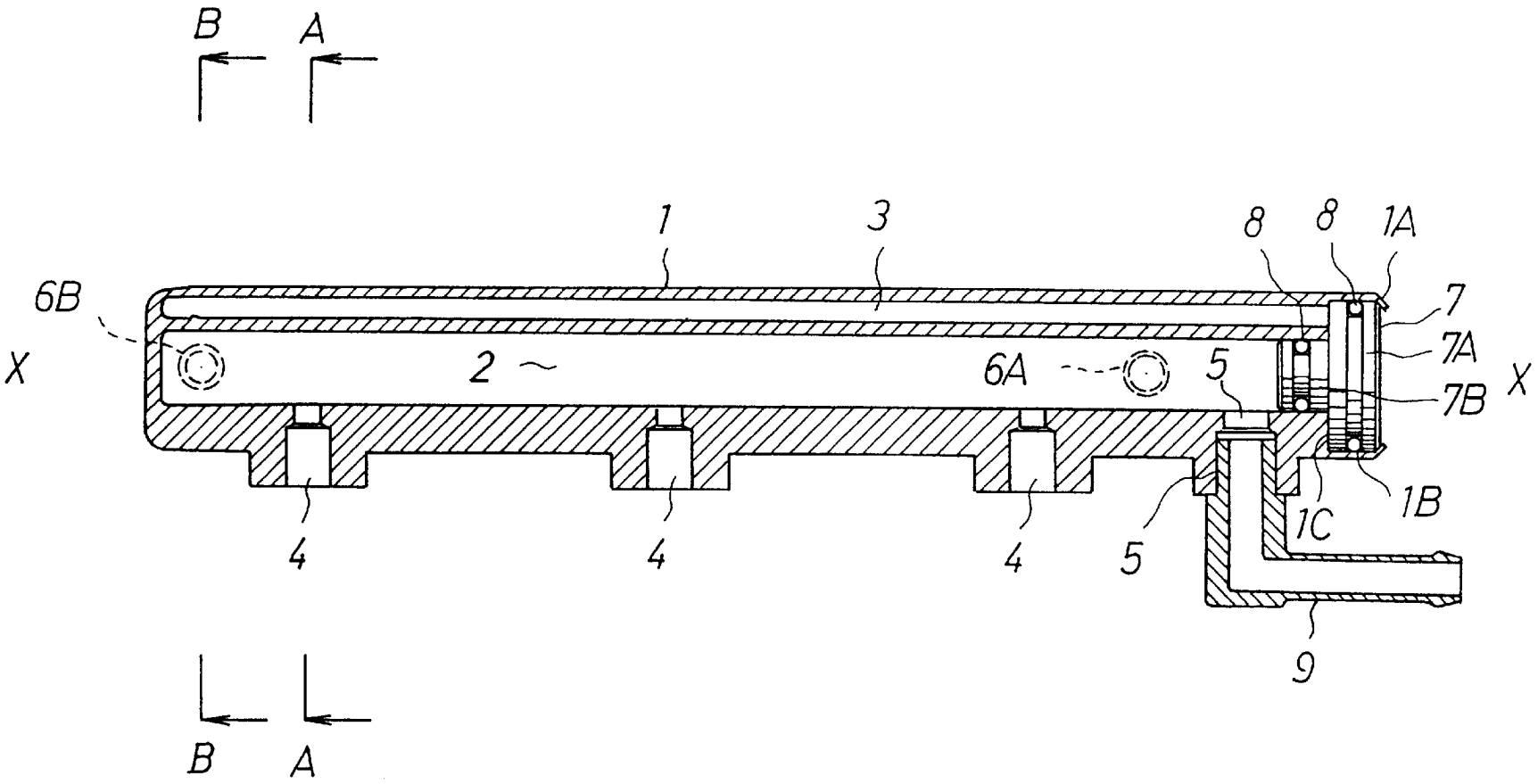
FIG. 1 is a vertical cross sectional view showing an embodiment of a fuel distribution pipe in a fuel injection apparatus in accordance with the present invention.
Figure 2:
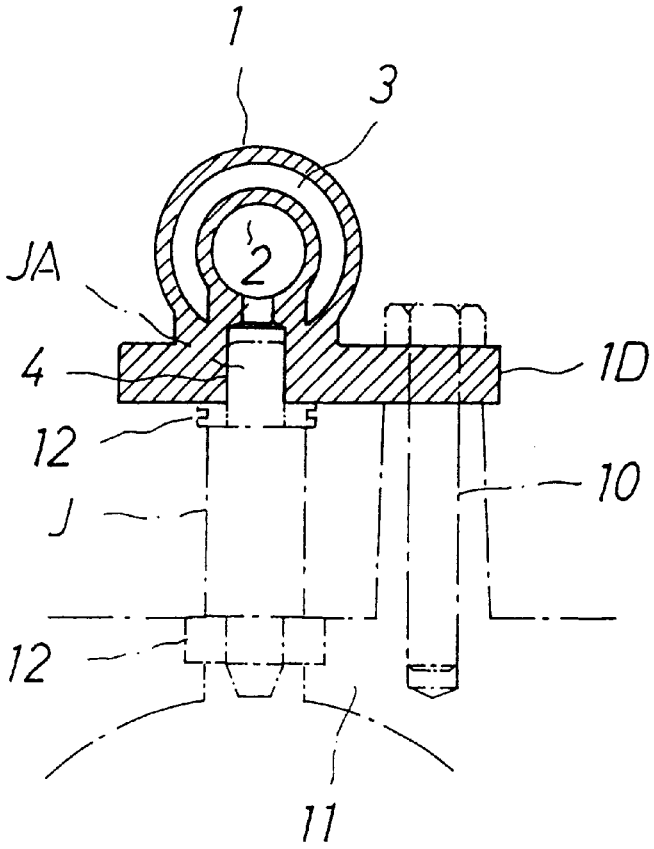
FIG. 2 is a vertical cross sectional view in a line A—A in FIG. 1.
Figure 3:
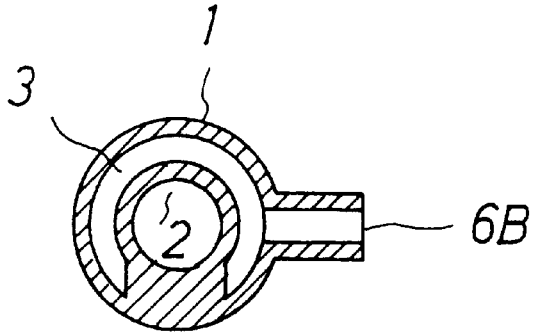
FIG. 3 is a vertical cross sectional view in a line B—B in FIG. 1.

FIG. 1 is a vertical cross sectional view of a fuel distribution pipe along a longitudinal direction, FIG. 2 is a vertical cross sectional view in a line A—A in FIG. 1, and FIG. 3 is a vertical cross sectional view in a line B—B in FIG. 1.

Reference numeral 1 denotes a fuel distribution pipe, in which a fuel distribution path 2 is pierced along a line X—X in a direction of a longitudinal axis and the fuel distribution path 2 is open toward one end portion 1A thereof.

Further, a cooling water flow path 3 is pierced on an outer periphery of the fuel distribution path 2 so as to extend along the line X—X in the direction of the longitudinal axis of the fuel distribution path 2 and surround the fuel distribution path 2, and this cooling water flow path 3 is also opened toward the one end portion 1A thereof.

Reference numeral 4 denotes an injection valve supporting hole for inserting a rear end portion JA of a fuel injection valve J so as to support, and the hole is pierced so as to vertically crosses toward the fuel distribution path 2 and is opened.

In the present embodiment, three injection valve supporting holes 4 are pierced along the line X—X in the direction of the longitudinal axis, however, the number thereof may be suitably selected.

Reference numeral 5 denotes a fuel introduction path, which is opened toward the fuel distribution path 2.

Reference numeral 6A denotes a cooling water introduction path for supplying cooling water toward the cooling water flow path 3, and reference numeral 6B denotes a cooling water discharge path for discharging the cooling water from the cooling water flow path 3. These paths are both opened to the cooling water flow path 3.

The cooling water introduction path 6A and the cooling water discharge path 6B are connected to a pipe for a radiator for cooing an engine or the like.

The fuel distribution path 2 and the cooling water flow path 3 are particularly opened to a bottom portion 1C of a circular hole 1B provided so as to be opened in one end portion 1A, and the circular hole 1B is closed by one side closing member 7.

The one side closing member 7 is formed of a large-diameter cylinder portion 7A inserted and arranged to the circular hole 1B in a liquid-tight manner and a small-diameter cylinder portion 7B inserted and arranged within the fuel distribution path 2 in a liquid-tight manner.

Then, the fuel distribution path 2, the cooling water flow path 3 and an atmospheric air are shut in a liquid-tight manner by inserting and arranging the small-diameter cylinder portion 7B of the one side closing member 7 within the fuel distribution path 2, and the cooling water flow path 3 and the atmospheric air are shut in a liquid-tight manner by inserting and arranging the large-diameter cylinder portion 7A in the circular hole 1B. Then, in a state mentioned above, an outer end of the one end portion 1A of the fuel distribution pipe 1 is inward caulked toward the above of the large-diameter cylinder portion 7A of the one side closing member 7, where by the one side closing member 7 is fixed to the fuel distribution pipe 1.

In this case, reference numeral 8 denotes a seal ring made of a rubber material for sealing in a liquid-tight manner.

In accordance with the structure mentioned above, the fuel distribution path 2 disposed along the line X—X in the direction of the longitudinal axis is formed in an inner portion of the fuel distribution pipe 1, the cooling water flow path 3 disposed along the line X—X in the direction of the longitudinal axis is formed on the outer periphery of the fuel distribution path 2 in such a manner as to be sectioned from the fuel distribution path 2, the injection valve supporting hole 4 and the fuel introduction hole 5 are opened to an inner portion of the fuel distribution path 2, and the cooling water introduction path 6A and the cooling water discharge path 6B are opened to the cooling water flow path 3.

Then, a fuel pipe 9 connected to a fuel source (not shown) is connected and arranged to the fuel introduction path 5, and a rear end portion JA of a fuel injection valve J is inserted and arranged to the injection valve supporting hole 4.

The fuel distribution pipe 1 mentioned above is structured, as shown in FIG. 2, such as to be fixed to an intake pipe 11 via a flange portion 1D extending to a right side direction by a bolt 10, at this time, the fuel injection valve J is gripped between the fuel distribution pipe 1 and the intake pipe 11 via an elastic member 12, and an injection hole (not shown) at a front end of the fuel injection valve J is opened and arranged toward an inner portion of the intake pipe 11.

Further, the fuel having a pressure increased by a fuel pump driven in correspondence to an operation of an engine is supplied into the fuel distribution path 2 of the fuel distribution pipe 1 via the fuel pipe 9 and the fuel introduction path 5, and the fuel within the fuel distribution path 2 is injected and supplied into the intake pipe 11 via the fuel injection valve J opened in response to a valve opening signal output from the ECU.

On the other hand, the cooling water branched from a water pipe in the radiator is supplied to the cooling water introduction path 6A, and the cooling water is supplied into the cooling water flow path 3 within the fuel distribution pipe 1, circulates through the cooling water flow path 3 and thereafter is returned to the water pipe in the radiator from the cooling water discharge path 6B again.

In accordance with the structure mentioned above, even in the case that the heated fuel is supplied into the fuel distribution path 2 of the fuel distribution pipe 1 from the fuel pipe 9, the fuel is cooled by the cooling water within the cooling water flow path 3 flowing so as to surround the outer periphery of the fuel distribution path 2, so that an increase of temperature of the fuel is restricted.

On the other hand, the fuel distribution pipe 1 is arranged near the engine so as to be heated, whereby the temperature of the fuel distribution pipe 1 itself is increased to make the temperature of the fuel within the fuel distribution path 2 increase, however, since the cooling water flow path 3 exists between the outer peripheral wall of the fuel distribution pipe land the fuel distribution path 2 so as to make it hard to transmit the increased temperature of the outer peripheral wall of the fuel distribution pipe 1 to the fuel distribution path 2, the fuel within the fuel distribution path 2 is never heated and the temperature thereof is not increased.

Accordingly, since it is possible to restrict an increase of temperature of the fuel of the fuel distribution path 2 within the fuel distribution pipe 1 during the operation of the engine, it is possible to prevent vapors from being generated in the fuel, whereby the fuel can be continuously supplied stably and accurately toward the inner portion of the intake pipe, so that it is possible to largely improve an operation property of the engine.

Further, since the fuel injection valve J repeats the opening and closing operations of the injection hole at the front end thereof during the operation of the engine, a pressure change is generated within the fuel distribution path 2 and there is a case that a sound is generated toward the outside.

However, in accordance with the present invention, since the outer periphery of the fuel distribution path 2 is surrounded by the cooling water flow path 3 along the line X—X in the direction of the longitudinal axis, the sound generated within the fuel distribution path 2 is shut by the cooling water of the cooling water flow path 3, whereby it is possible to largely reduce the sound from the outer periphery of the fuel distribution pipe 1 toward the outside.

Then, in accordance with the structure in which the cooling water introduction path 6A and the cooling water discharge path 6B are opened to the cooling water flow path, since the cooling water is always circulated within the cooling water flow path 3 during the operation of the engine, it is possible for the cooling water to continuously absorb and radiate a heat, so that it is possible to effectively restrict an increase of temperature of the fuel within the fuel distribution path 2.

A description will be given of another embodiment with reference to FIG. 4.

Figure 4:
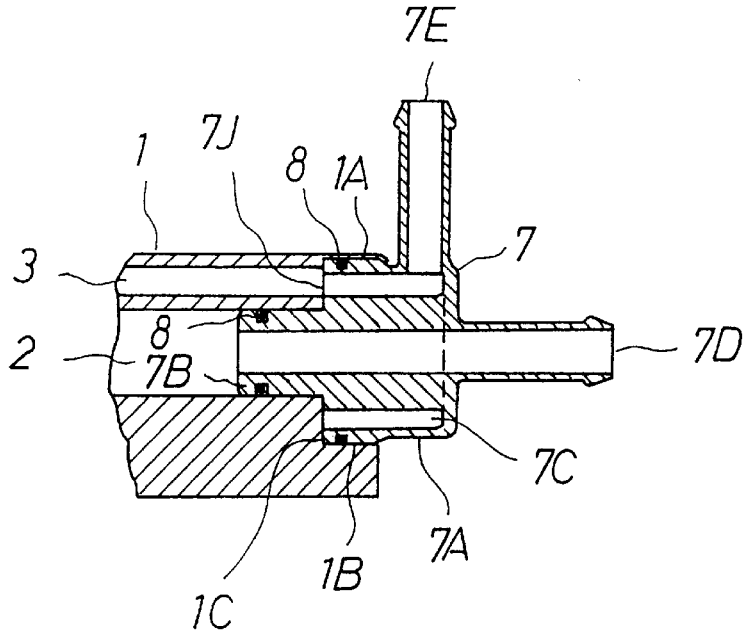
FIG. 4 is a vertical cross sectional view of a main portion of one side closing member showing another embodiment in accordance with the present invention.

FIG. 4 shows the one end portion 1A of the fuel distribution pipe 1 and the one side closing member 7.

The fuel distribution pipe 1 is structured such that the fuel distribution path 2 and the cooling water flow path 3 are formed along the line X—X in the direction of the longitudinal axis by a casting process such as an injection molding or the like and the flow paths 2 and 3 are opened to the bottom portion 1C of the circular hole 1B provided in the one end portion 1A.

In this case, the injection valve supporting hole 4 and the cooling water discharge path 6B (both are omitted and not illustrated) maybe formed by a casting process or by a machining process.

The one side closing member 7 arranged in the circular hole 1B of the one end portion 1A has the large-diameter cylinder portion 7A and the small-diameter cylinder portion 7B in the same manner as that in FIG. 1, and further has the following structure.

Reference numeral 7C is a cooling water groove portion formed in an inner portion near the outer periphery of the large-diameter cylinder portion 7A, and the cooling water groove portion 7C is formed so as to be opened to a left end portion 7J of the large-diameter cylinder portion 7A in such a manner as to face to the cooling water flow path 3 opening to the bottom portion 1C of the circular hole 1B.

Reference numeral 7D denotes a fuel introduction path provided in such a manner as to extend through an approximate center of the large-diameter cylinder portion 7A and the small-diameter cylinder portion 7B, one end thereof is protruded rightward in the figure so as to form a pipe shape and opened, and another end thereof is opened to a left end surface of the small-diameter cylinder portion 7B.

Reference numeral 7E denotes a cooling water introduction path provided in a side portion of the large-diameter cylinder portion 7A, and the cooling water introduction path 7E is opened within the cooling water groove portion 7C.

In this case, in the embodiment mentioned above, the fuel introduction path 5, the fuel pipe 9 and the cooling water introduction path 6A illustrated in FIG. 1 are not required.

Then, the large-diameter cylinder portion 7A of the one side closing member 7 is inserted and arranged in the circular in hole 1B in a liquid-tight manner, the small-diameter cylinder portion 7B is inserted and arranged within the fuel distribution path 2 in a liquid-tight manner, and the one end portion 1A of the fuel distribution pipe 1 is inward caulked toward the large-diameter cylinder portion 7A in this state, whereby the closing member 7 is fixed to one end of the fuel distribution pipe 1.

Accordingly, the fuel introduction path 7D is connected and opened to the fuel distribution path 2 via a left end surface of the small-diameter cylinder portion 7B, and the cooling water introduction path 7E is connected to the cooling water flow path 3 via the cooling water groove portion 7C.

In accordance with the structure mentioned above, it is possible to reduce the number of the parts and to make the shape of the fuel distribution pipe 1 simple so as to reduce a producing cost by forming the fuel distribution pipe 1 provided with the fuel distribution path 2 and the cooling water flow path 3 by a casting process and forming the fuel introduction path 7D and the cooling water introduction path 7E integrally with the one side closing member 7 for closing the one end portion 1A of the fuel distribution pipe 1. Further, in accordance with the structure obtained by providing the cooling water introduction path 7E in the one side closing member 7 and arranging and fixing the large-diameter cylinder portion 7A of the one side closing member 7 to the circular hole 1B of the one end portion 1A, it is possible to freely arrange the opening position of the cooling water introduction path 7E by rotating the large-diameter cylinder portion 7A so as to position and fix, so that it is possible to improve a freedom of the pipe of the cooling water path.

A description will be given of the other embodiment with reference to FIG. 5.

Figure 5:
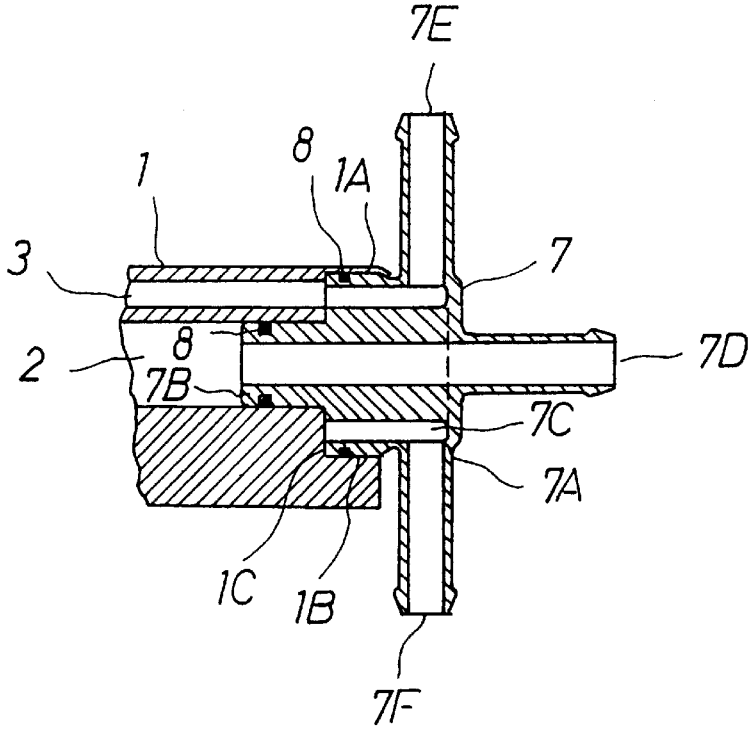
FIG. 5 is a vertical cross sectional view of a main portion of one side closing member showing the other embodiment in accordance with the present invention.

FIG. 5 shows a structure in which a cooling water discharge path 7F is added to the embodiment shown in FIG. 4.

The cooling water discharge path 7F is provided in a side portion of the large-diameter cylinder portion 7A of the one side closing member 7, and the cooling water discharge path 7F is communicated with the cooling water flowpath 3 via the cooling water groove portion 7C.

In accordance with the present embodiment, the cooling water flows into the cooling water flow path 3 via the cooling water groove portion 7C from the cooling water introduction path 7E and next is discharged from the cooling water groove portion 7C via the cooling water discharge path 7F. In accordance with the structure mentioned above, since the fuel introduction path 7D, the cooling water introduction path 7E and the cooling water discharge path 7F are provided in the one side closing member 7, it is not necessary to provide each of the flow paths 7D, 7E and 7F in the fuel distribution pipe 1 itself, and the structure of the fuel distribution pipe 1 itself is further made simple so as to make it easy to produce the fuel distribution pipe 1, thereby further reducing a producing cost, and since each of the flow paths is formed in the one side closing member 7 together, it is possible to achieve reduction of parts cost.

Next, a description will be given of the other embodiment with reference to FIGS. 6 to 9.

Figure 6:
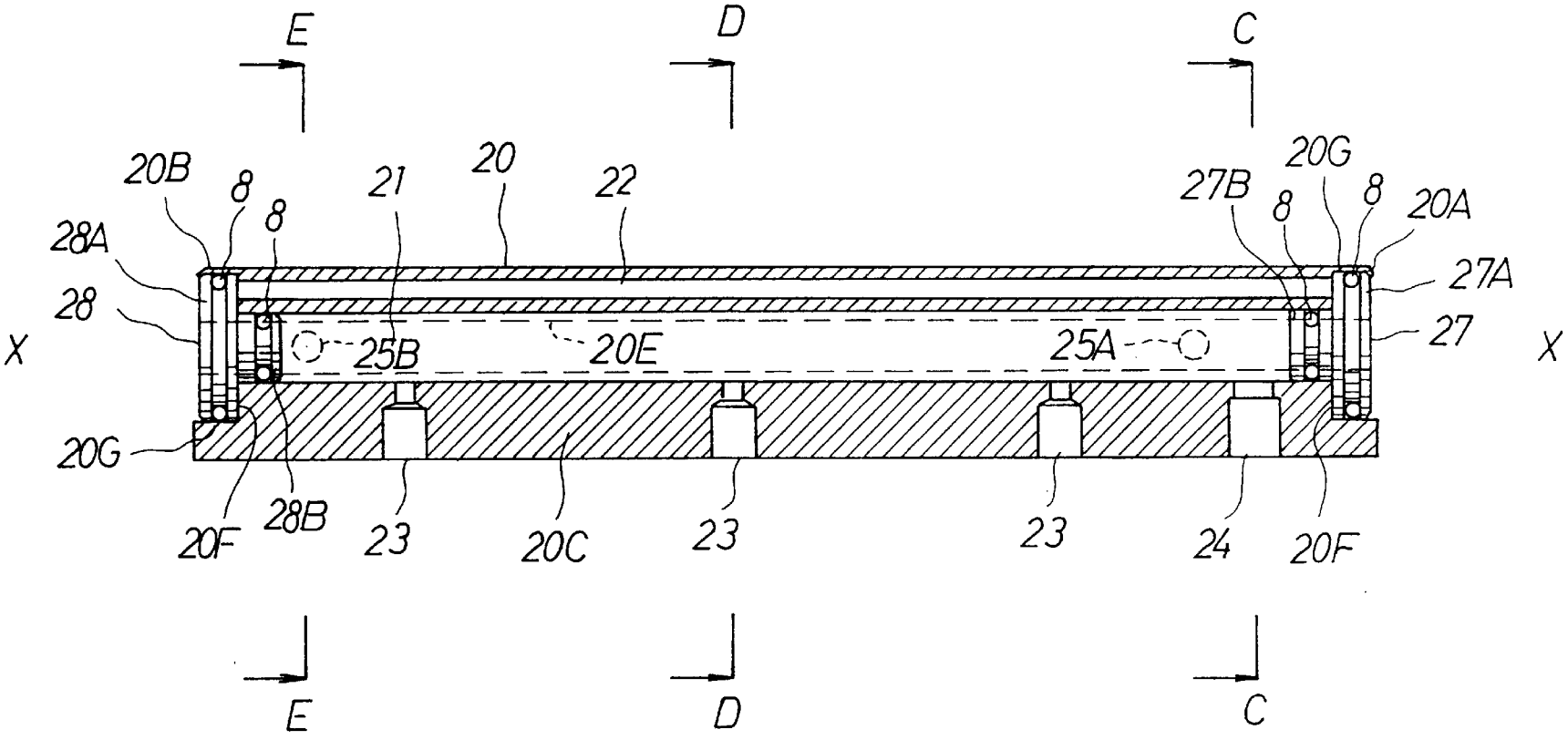
FIG. 6 is a vertical cross sectional view showing the other embodiment in accordance with the present invention.

FIG. 6 is a vertical cross sectional view of the fuel distribution pipe along a longitudinal direction.

Figure 7:
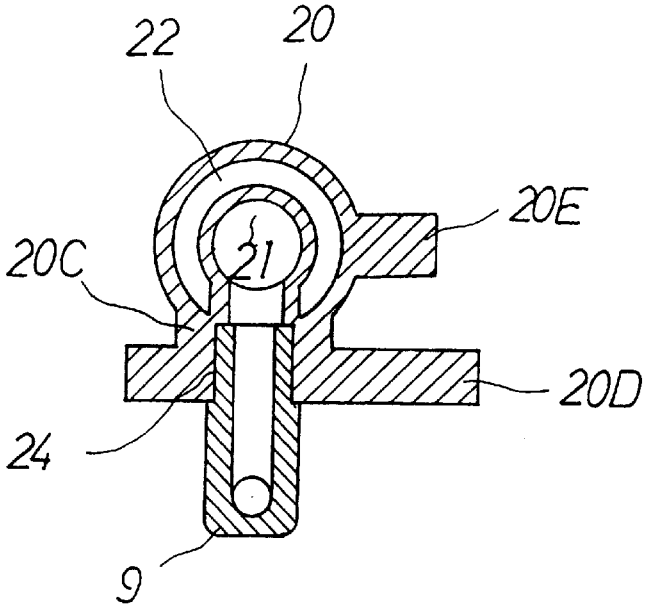
FIG. 7 is a vertical cross sectional view in a line C—C in FIG. 6.

FIG. 7 is a vertical cross sectional view in a line C—C in FIG. 6.

Figure 8:
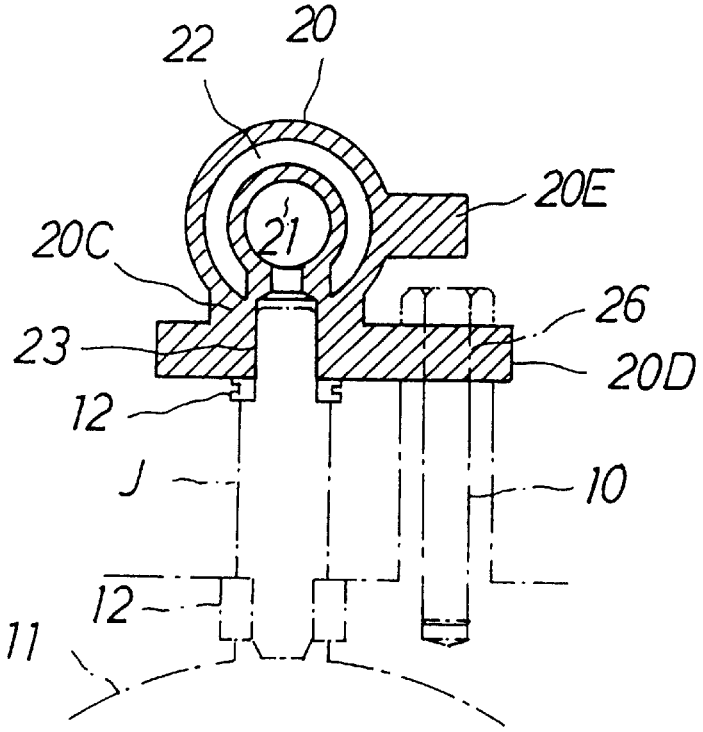
FIG. 8 is a vertical cross sectional view in a line D—D in FIG. 6.

FIG. 8 is a vertical cross sectional view in a line D—D in FIG. 6.

Figure 9:
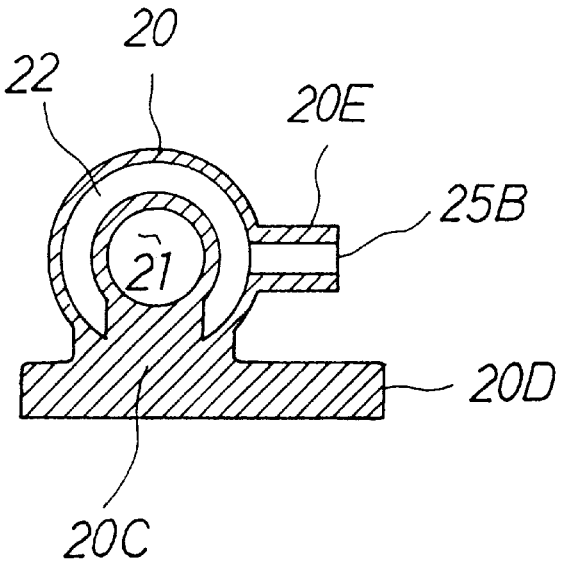
FIG. 9 is a vertical cross sectional view in a line E—E in FIG. 6.

FIG. 9 is a vertical cross sectional view in a line E—E in FIG. 6.

Reference numeral 20 denotes a fuel distribution pipe, in which a fuel distribution path 21 is pierced along a line X—X in a direction of a longitudinal axis and a cooling water flow path 22 is pierced along the line X—X in the direction of the longitudinal axis so as to surround the fuel distribution path 21. The fuel distribution pipe 20 including the fuel distribution path and the cooling water flow path 22 is formed continuously from one end portion 20A toward another end portion 20B in the line X—X in the direction of the longitudinal axis by a drawing process.

Reference numeral 20C denotes a fuel boss, which is formed below the fuel distribution pipe 20 in FIG. 7 and in which an injection valve supporting hole and a fuel introduction hole mentioned below are pierced, reference numeral 20D denotes a flange portion formed in a lower right side portion in FIG. 7, and reference numeral 20E denotes a cooling water boss formed in a center right side portion in FIG. 7.

Then, the fuel boss 20C, the flange portion 20D and the cooling water boss 20E are also formed continuously from the one end portion 20A toward the another end portion 20B by a drawing process. In other words, a cross sectional shape shown in FIG. 7 is formed by a drawing process as a raw material.

Further, the following working process is applied to the fuel distribution pipe 20 formed by a drawing process. Reference numeral 23 denotes an injection valve supporting hole for inserting and supporting a rear end portion of a fuel injection valve J. The injection valve supporting hole 23 is pierced so as to be opened from the lower end of the fuel boss 20C toward the inner portion of the fuel distribution path 21.

Further, reference numeral 24 denotes a fuel introduction hole for pressure inserting and arranging the fuel pipe 9. The fuel introduction hole 24 is pierced so as to be opened from the lower end of the fuel boss 20C toward the inner portion of the fuel distribution path 21.

These elements are well shown in FIG. 6.

Further, reference numeral 25A denotes a cooling water introduction path and reference numeral 25B denotes a cooling water discharge path. These elements are pierced in the cooling water boss 20E so as to be opened to the cooling water flow path 22. The cooling water discharge path 25B is well shown in FIG. 9.

Further, reference numeral 26 denotes a bolt mounting hole pierced through the flange portion 20D. This element is well shown in FIG. 8.

Further, a circular hole 20G provided with a bottom portion 20F is pierced in the one end portion 20A and the another end portion 20B in the fuel distribution pipe 20, one end (a right end) of each of the fuel distribution path 21 and the cooling water flow path 22 is opened to the bottom portion 20F of the circular hole 20G in one side, and another end (a left end) of each of the fuel distribution path 21 and the cooling water flow path 22 is opened to the bottom portion 20F of the circular hole 20G in another side.

Then, the following structure is assembled in the fuel distribution pipe 20 formed by a drawing process.

The rear end portion of the fuel injection valve J is inserted and arranged in the injection valve supporting hole 23 in a liquid-tight manner. This structure is well shown in FIG. 8.

Further, the fuel pipe 9 connected to the fuel pump (not shown) is pressure inserted to the fuel introduction hole 24.

The one side closing member 27 is formed of a large-diameter cylinder portion 27A inserted and arranged to a circular hole 20G in one side in a liquid-tight manner and a small-diameter cylinder portion 27B inserted and arranged within the one side fuel distribution path 21 in a liquid-tight manner, the fuel distribution path 21, the cooling water flow path 22 and the atmospheric air are shut in a liquid-tight manner by inserting and arranging the small-diameter cylinder portion 27B in the one side closing member into one side of the fuel distribution path 21, and the cooling water flow path 22 and the atmospheric air are shut in a liquid-tight manner by inserting and arranging the large-diameter cylinder portion 27A into the circular hole 20G in one side.

Then, in the state mentioned above, one end portion 20A of the fuel distribution pipe 20 is inward caulked toward the above of the large-diameter cylinder portion 27A of the one side closing member 27, whereby the one side closing member 27 is fixed to the one end portion 20A of the fuel distribution pipe 20.

The another side closing member 28 is formed of a large-diameter cylinder portion 28A inserted and arranged to a circular hole 20G in another side in a liquid-tight manner and a small-diameter cylinder portion 28B inserted and arranged within the fuel distribution path 21 in another side in a liquid-tight manner, the fuel distribution path 21, the cooling water flow path 22 and the atmospheric air are shut in a liquid-tight manner by inserting and arranging the small-diameter cylinder portion 28B in the another side closing member into another side of the fuel distribution path 21, and the cooling water flow path 22 and the atmospheric air are shut in a liquid-tight manner by inserting and arranging the large-diameter cylinder portion 28A into the circular hole 20G in another side.

Then, in the state mentioned above, the another end portion 20B of the fuel distribution pipe 20 is inward caulked toward the above of the large-diameter cylinder portion 28A of the another side closing member 28, whereby the another side closing member 28 is fixed to the another end portion 20B of the fuel distribution pipe 20.

In this case, reference numeral 8 denotes a seal ring made of a rubber material for sealing in a liquid-tight manner.

The fuel distribution pipe 20 having the structure mentioned above is structured such as to be fixed to the intake pipe 11 via the bolt mounting hole 26 in the flange portion 20D by the bolt 10, and at this time, the fuel injection valve J is held between the fuel distribution pipe 20 and the intake pipe 11 via the elastic member 12. This structure is well shown in FIG. 8.

In accordance with the fuel distribution pipe 20 structured as mentioned above, the fuel within the fuel distribution pipe 21 is cooled by the cooling water within the cooling water flow path 22 in the same manner as that of the fuel distribution pipe 1 shown in FIG. 1, where by the temperature of the fuel is prevented from being increased. Further, it is possible to reduce the sound generated from the fuel distribution pipe 20 toward the outside.

Further, in accordance with the present embodiment, since the fuel distribution path 21 and the cooling water flow path 22 are formed by drawing the fuel distribution pipe 20 and the opening of each of the flow path is closed and formed in a sectional manner by the one side and another side closing members 27 and 28, it is possible to reduce a producing cost thereof.

A description will be given of the other embodiment with reference to FIG. 10.

Figure 10:
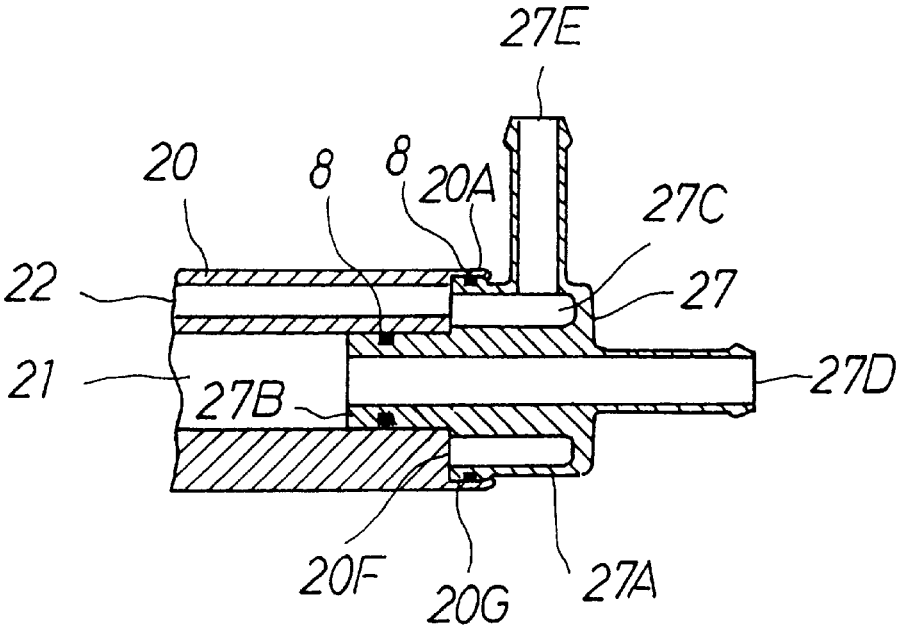
FIG. 10 is a vertical cross sectional view of a main portion of one side closing member showing the other embodiment in accordance with the present invention.

FIG. 10 shows the one end portion 20A of the fuel distribution pipe 20 and the one side closing member 27 in FIG. 6.

The one side closing member 27 arranged in the circular hole 20G of the one end portion 20A has the large-diameter cylinder portion 27A and the small-diameter cylinder portion 27B in the same manner as that of FIG. 6 and further has the following structure.

Reference numeral 27C denotes a cooling water groove portion formed in the inner portion of the large-diameter cylinder portion 27A. The cooling water groove portion 27C is arranged so as to face to the cooling water flow path 21 opened to the bottom portion 20F of the circular hole 20G.

Reference numeral 27D denotes a fuel introduction path extending through the large-diameter cylinder portion 27A and the small-diameter cylinder portion 27B and having one end rightward protruding so as to be opened and another end opened to a left end surface of the small-diameter cylinder portion 27B.

Reference numeral 27E denotes a cooling water introduction path provided in a side portion of the large-diameter cylinder portion 27A. The cooling water introduction path 27E is opened into the cooling water groove 27C.

In the present embodiment, the fuel introduction hole 24 and the cooling water introduction hole 25A in FIG. 6 are not required. Further, the one side closing member 27 is fixed and arranged within the circular hole 20G in one side of the fuel distribution pipe 20, the fuel introduction path 27D is connected to the fuel pump, and the cooling water introduction path 27E is connected to a cooling pipe of a radiator or the like.

Accordingly, the fuel having the pressure increased by the fuel pump is supplied into the fuel distribution path 21 via the fuel introduction path 27D of the one side closing member 27, and on the other hand, the cooling water is supplied into the cooling water flow path 21 via the cooling water introduction path 27E and the cooling water groove portion 27C of the one side closing member 27.

In accordance with the structure mentioned above, the fuel distribution pipe 20 provided with the fuel distribution path 21 and the cooling water flow path 22 is formed by a drawing process, and the fuel introduction path 27D and the cooling water introduction path 27E are integrally formed in the one side closing member 27 closing the one end portion 20A of the fuel distribution pipe 20, whereby it is possible to reduce the number of the parts and to reduce a producing cost thereof.

A description will be given of the other embodiment with reference to FIG. 11.

Figure 11:
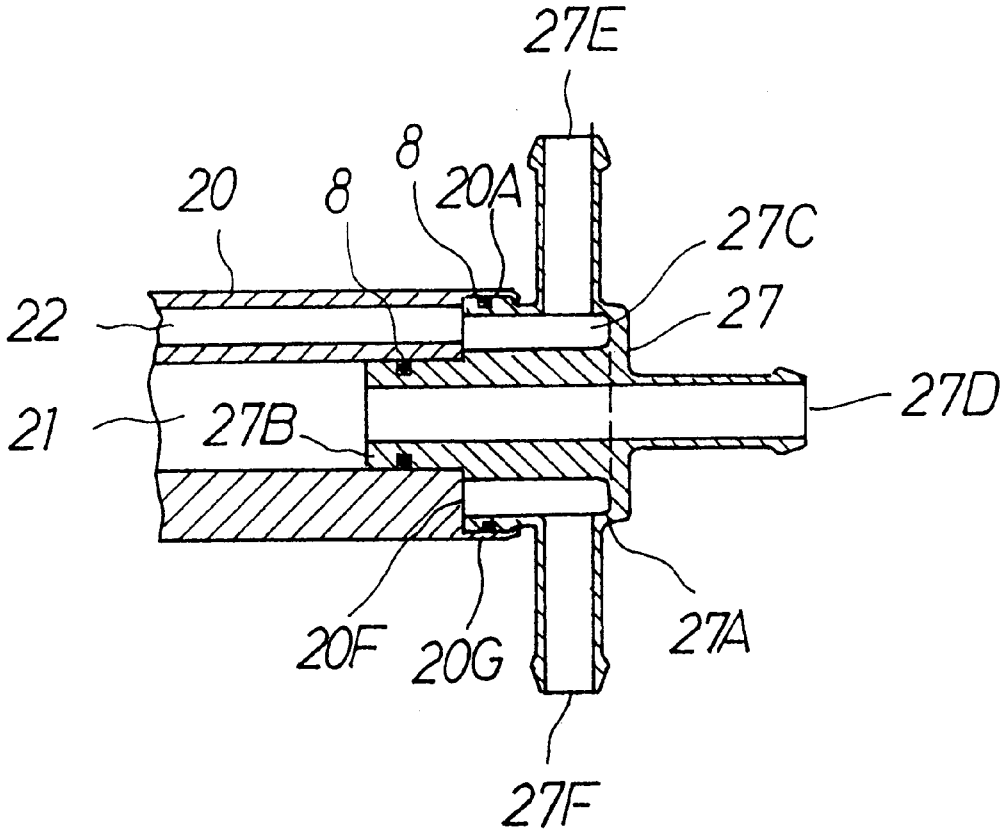
FIG. 11 is a vertical cross sectional view of a main portion of one side closing member showing the other embodiment in accordance with the present invention.

FIG. 11 shows a structure in which a cooling water discharge path 27F is added to the embodiment shown in FIG. 10. The cooling water discharge path 27F is provided in a side portion of the large-diameter cylinder portion 27A of the one side closing member 27, and the cooling water discharge path 27F is communicated with the cooling water groove portion 27C. In accordance with the present embodiment, the cooling water flows into the cooling water flow path 21 from the cooling water introduction path 27E via the cooling water groove portion 27C and next is discharged from the cooling water groove portion 27C via the cooling water discharge path 27F. In accordance with the structure mentioned above, since the fuel introduction path 27D, the cooling water introduction path 27E and the cooling water discharge path 27F are provided in the one side closing member 27, it is not necessary to provide each of the flow paths 27D, 27E and 27F in the fuel distribution pipe 20 itself, and the structure of the fuel distribution pipe 20 itself is further made simple so as to reduce a producing cost, and since each of the flow paths is formed in the one side closing member 27 together, it is possible to achieve reduction of parts cost.

Figure 12:
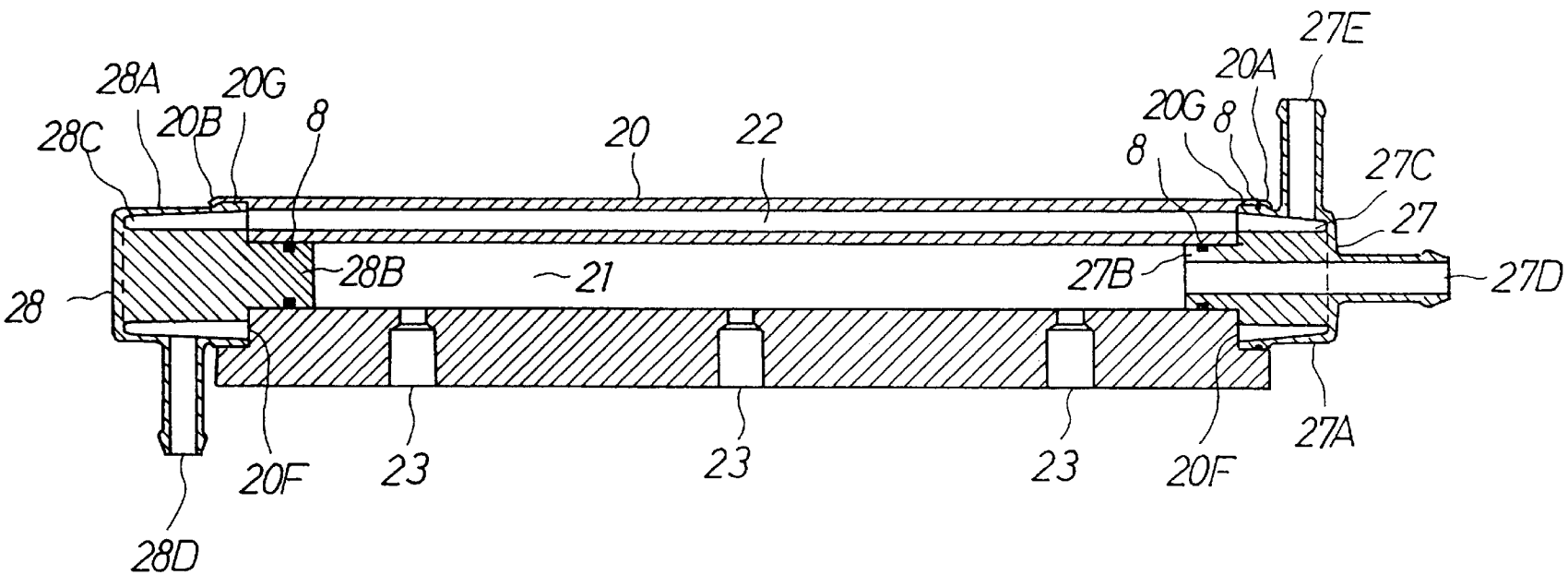
FIG. 12 is a vertical cross sectional view showing the other embodiment in accordance with the present invention.

Next, a description will be given of the other embodiment with reference to FIG. 12.

In this embodiment, the structure of the one side closing member 27 and the another side closing member 28 is different from the embodiment shown in FIG. 6, and among them, one side closing member 27 shown in FIG. 10 is employed for the one side closing member 27. Accordingly, a description of the one side closing member 27 will be omitted.

The another side closing member 28 is formed of a large-diameter cylinder portion 28A inserted and arranged to the circular hole 20G in another side in a liquid-tight manner and a small-diameter cylinder portion 28B inserted and arranged into the fuel distribution path 21 in another side in a liquid-tight manner, and a cooling water groove portion 28C facing to the cooling water flow path 21 opening to the bottom portion 20F of the circular hole 20G is formed in the inner portion of the large-diameter cylinder portion 28A.

Further, a cooling water discharge path 28D connected to the cooling water groove portion 28C is formed in the large-diameter cylinder portion 28A of the another side closing member 28.

The small-diameter cylinder portion 28B of the another side closing member 28 is inserted and arranged into the fuel distribution path 21 in the another side, whereby the fuel distribution path 21, the cooling water flow path 22 and the atmospheric air are shut, and the large-diameter cylinder portion 28A is inserted and arranged into the circular hole 20G, whereby the cooling water flow path 22 and the atmospheric air are shut, so that the cooling water discharge path 28D is communicated via the cooling water groove portion 28C.

In accordance with the structure mentioned above, the fuel having the pressure increased by the fuel pump is supplied into the fuel distribution path 21 of the fuel distribution pipe 20 through the fuel introduction path 27D provided in the one side closing member 27.

Further, the cooling water supplied to the cooling water introduction path 27E of the one side closing member 27 is supplied into the cooling water flow path 22 of the fuel distribution pipe 20 via the cooling water groove portion 27C of the one side closing member 27, next flows downward within the cooling water flow path 22 from a left portion toward a right portion, and next is discharged from the cooling water discharge path 28D via the cooling water groove portion 28C of the another side closing member 28.

As mentioned above, since the cooling water is positively flown downward from one side of the cooling water flow path 22 toward another side, it is possible to significantly effectively cool the fuel within the fuel distribution path 21.

Further, in the case that the fuel introduction path 27D and the cooling water introduction path 27E are provided in the one side closing member 27 and the cooling water discharge path 28D is provided in the another side closing member 28, it is not necessary to provide the flow path in the fuel distribution pipe 20 itself, so that it is possible to make a shape of the fuel distribution pipe 20 simple and it is particularly effective at a time of forming the fuel distribution pipe 20 by a drawing process.

A description will be given of the other embodiment with reference to FIG. 13.

Figure 13:
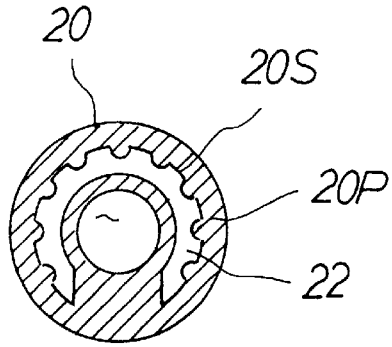
FIG. 13 is a vertical cross sectional view of a fuel distribution pipe showing the other embodiment in accordance with the present invention.

FIG. 13 corresponds to a cross section vertically crossing to the line X—X in the direction of the longitudinal axis of the fuel distribution pipe.

Reference numeral 20P denotes a heat radiating fin provided on an inner peripheral wall 20S of the cooling water flow path 22, and a plurality of the heat radiating fins 20P are formed and provided along the line X—X in the direction of the longitudinal axis of the fuel distribution pipe.

In accordance with the structure mentioned above, since the heat of the fuel distribution pipe 20 heated by the fuel flowing within the fuel distribution path 21 and the atmosphere of the fuel distribution pipe 20 is effectively radiated toward the cooling water flowing through the cooling water flow path 22 by the heat radiating fins 20P, it is possible to effectively restrict an increase of temperature of the fuel within the fuel distribution path 21.

Further, it is effective in view of increasing an area for heat radiation by the heat radiating fins 20P to form the heat radiating fins 20P along the line X—X in the direction of the longitudinal axis of the fuel distribution pipe 20, and in accordance with the structure, it is significantly easy to form the heat radiating fins 20P as above when the fuel distribution pipe is formed by an injection molding process and a drawing process.

Figure 14:
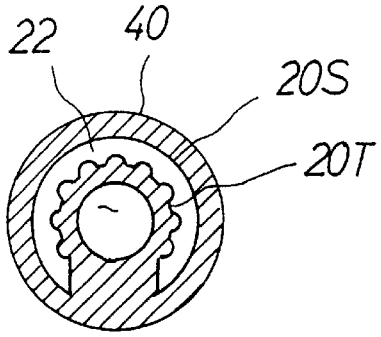
FIG. 14 is a vertical cross sectional view of a fuel distribution pipe showing the other embodiment in accordance with the present invention.

FIG. 14 shows the other embodiment of the heat radiating fins 20P. The heat radiating fins 20P are provided on an outer peripheral wall 20T of the fuel distribution path 21 and a plurality of the heat radiating fins 20P are formed and provided along the line X—X in the direction of the longitudinal axis of the fuel distribution pipe in the same manner as that of the embodiment mentioned above.

In accordance with the present embodiment, since the heat radiating fins 20P are provided on the outer periphery of the fuel distribution path 21, it is possible to more effectively restrict an increase of temperature of the fuel within the fuel distribution path 21.

A description will be given of the other embodiment with reference to FIGS. 15 and 16.

Figure 15:
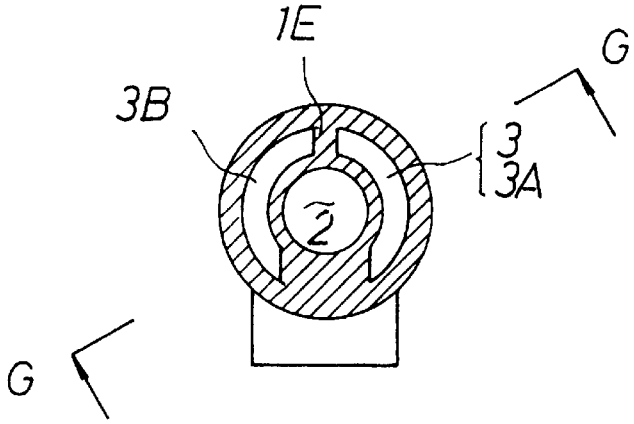
FIG. 15 is a vertical cross sectional view of a fuel distribution pipe showing the other embodiment in accordance with the present invention.

FIG. 15 is a vertical cross sectional view vertically crossing to a direction of a longitudinal axis of a fuel distribution pipe.

Figure 16:
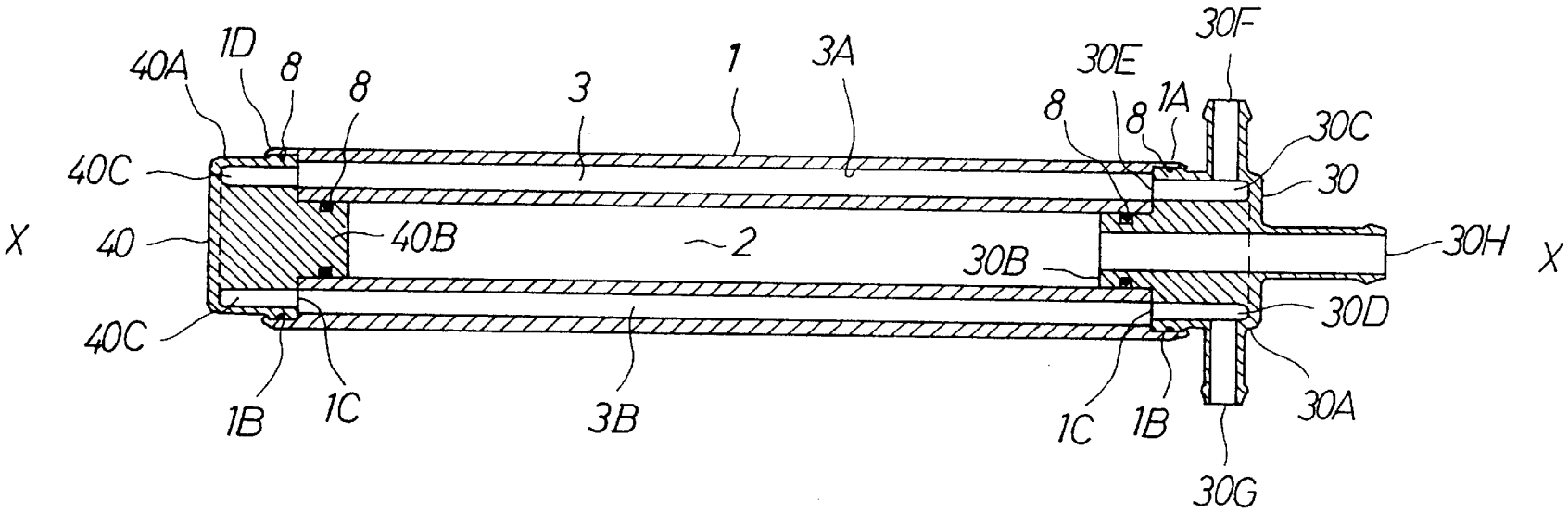
FIG. 16 is a vertical cross sectional view in a line G—G in FIG. 15.

FIG. 16 is a vertical cross sectional view in a line G—G in FIG. 15.

A fuel distribution pipe 1 is structured such that a fuel distribution path 2 and a cooling water flow path 3 are opened to a bottom portion 1C of a circular hole 1B in one end portion 1A, and the fuel distribution path 2 and the cooling water flow path 3 extend toward the another side along the line X—X in the longitudinal axis and opened to the bottom portion 1C of the circular hole 1B in another end portion 1D.

Reference numeral 1E denotes a partition wall formed within the cooling water flow path 3 along the line X—X in the direction of the longitudinal axis of the fuel distribution pipe 1. The partition wall 1E sections the cooling water flow path 3 into a first cooling water flow path 3A and a second cooling water flowpath 3B along the line X—X in the direction of the longitudinal axis.

Accordingly, one end of each of the first cooling water flow path 3A and the second cooling water flow path 3B is opened to the bottom portion 1C of the circular hole 1B in one side, and another end of each of the first cooling water flow path 3A and the second cooling water flow path 3B is opened to the bottom portion 1C of the circular hole 1B in another end.

Reference numeral 30 denotes one side closing member arranged in the one end portion 1A of the fuel distribution pipe 1. The oneside closing member is provided with a large-diameter cylinder portion 30A inserted and arranged to the circular hole 1B in a liquid-tight manner and a small-diameter cylinder portion 30B arranged in the fuel distribution path 2 in a liquid-tight manner, and further a first cooling water groove portion 30C facing to the first cooling water flow path 3A and a second cooling water groove portion 30D facing to the second cooling water flow path 3B are recessed in the large-diameter cylinder portion 30.

The first and second cooling water groove portions 30C and 30D are formed so as to be sectioned and are opened to a step portion 30E in a side of the small-diameter cylinder portion 30B of the large-diameter cylinder portion 30A.

Further, reference numeral 30F denotes a cooling water introduction path opened to the first cooling water groove portion 30C and reference numeral 30G denotes a cooling water discharge path opened to the second cooling water groove portion 30D. Further, reference numeral 30H denotes a fuel introduction path opened to an end portion of the small-diameter cylinder portion 30B.

Then, the small-diameter cylinder portion 30B of the one side closing member 30 is inserted and arranged into one end of the fuel distribution path 2, whereby the fuel distribution path 2, the cooling water flow path 3 (the first and second cooling water flow paths 3A and 3B) and the atmospheric air are shut in a liquid-tight manner, and the large-diameter cylinder portion 30A is inserted and arranged into the circular hole 1B, whereby the cooling water flow path 3 and the atmospheric air are shut in a liquid-tight manner.

Further, the step portion 30E of the large-diameter cylinder portion 30A is brought into contact with the bottom portion 1C of the circular hole 1B, whereby the first cooling water groove portion 30C is communicated with the first cooling water flow path 3A and the second cooling water groove portion 30D is communicated with the second cooling water flow path 3B.

In the state mentioned above, the one side closing member 30 is fixed to the one end portion 1A of the fuel distribution pipe 1.

Reference numeral 40 denotes another side closing member arranged in the another end portion 1D of the fuel distribution pipe 1. The another side closing member is provided with a large-diameter cylinder portion 40A inserted and arranged to the circular hole 1B in a liquid-tight manner and a small-diameter cylinder portion 40B arranged in the fuel distribution path 2 in a liquid-tight manner, and further a communicating groove 40C which faces to the first cooling water flow path 3A and the second cooling water flow path 3B and communicates both of the flow paths 3A and 3B is formed in the large-diameter cylinder portion 40A.

Then, the fuel distribution path 2, the cooling water flow path 3 and the atmospheric air are shut in a liquid-tight manner by inserting and arranging the small-diameter cylinder portion 40B into the another end of the fuel distribution path 2, and the cooling water flow path 3 and the atmospheric air are shut in a liquid-tight manner by inserting and arranging the large-diameter cylinder portion 40A into the circular hole 1B. Further, the first cooling water flow path 3A and the second cooling water flow path 3B which are opened to the bottom portion 1C are communicated with each other by the communicating groove 40C.

In the state mentioned above, the another side closing member 40 is fixed to the another end portion 1D of the fuel distribution pipe 1.

In accordance with the structure mentioned above, the cooling water flows in the manner mentioned below in the fuel distribution pipe 1.

The cooling water entering from the cooling water introduction path 30F flows into the first cooling water flow path 3A from the first cooling water groove portion 30C, flows downstream from one end thereof toward another end, and next flows into the communicating groove 40C of the another side closing member 40.

Further, the cooling water within the communicating groove 40C enters into the second cooling water flow path 3B, the cooling water flows within the second cooling water flow path 3B from another end toward one end and is discharged from the cooling water discharge path 30G via the second cooling water groove portion 30D.

In accordance with the structure mentioned above, since the cooling water is securely U-turned within the fuel distribution pipe 1 so as to generate a two-way flow, it is possible to more effectively cool the fuel within the fuel distribution path 2 so as to restrict an increase of temperature of the fuel.

Further, it is effective in view of increasing a rigidity of the fuel distribution pipe 1 that the partition wall 1E is formed along the direction of the longitudinal axisre of the fuel distribution pipe 1, whereby it is possible to achieve an increase of strength of the fuel distribution pipe 1 itself and an improvement of accuracy of a size.

In accordance with the first aspect of the fuel distribution pipe in the fuel injection apparatus of the present invention, since the fuel distribution pipe is pierced along the line X—X in the direction of the longitudinal axis thereof and the injection valve supporting hole for inserting and supporting the rear end portion of the fuel injection valve and the fuel introduction path for supplying the fuel having the pressure increased by the fuel pump are continuously provided in the fuel distribution path of the fuel distribution pipe, and the cooling water flow path extending along the line X—X in the direction of the longitudinal axis of the fuel distribution path and sectioned from the fuel distribution path is provided on the outer periphery of the fuel distribution path, thereby introducing the cooling water into the cooling water flow path, the fuel within the fuel distribution path is cooled within the fuel distribution pipe by the cooling water within the cooling water flow path surrounding the fuel distribution path, whereby it is possible to restrict an increased of temperature of the fuel so as to stably and accurately supply the fuel, thereby improving an operation property of the engine. Further, since the outer periphery of the fuel distribution path is surrounded by the cooling water flow path, it is possible to prevent the sound generated within the fuel distribution path from being transmitted to the outside.

Further, in accordance with the structure made such that the cooling water introduction path and the cooling water discharge path are opened to the cooling water flowpath, thereby circulating the cooling water within the cooling water flow path, it is possible to improve an effect of cooling the fuel within the fuel distribution path.

Further, in accordance with the structure made such that the fuel distribution path and the cooling water flow path are formed within the fuel distribution pipe in a sectional manner by forming the fuel distribution path and the cooling water flow path formed in the fuel distribution pipe so as to be opened in the one end portion by a casting process and closing the one end portion by the one side closing member, and the fuel introduction path connected to the fuel distribution path and the cooling water introduction path connected to the cooling water flow path are provided in the one side closing member, since the fuel introduction path and the cooling water introduction path are provided in the one side closing member, it is easy to produce the fuel distribution pipe by an injection molding process and it is possible to achieve reduction of a producing cost.

Further, in accordance with the structure made such that the fuel introduction path connected to the fuel distribution path, the cooling water introduction path connected to the cooling water flow path and the cooling water discharge path are provided in the one side closing member, it is further promoted to concentrate the parts into the one side closing member and it is possible to achieve further reduction of the producing cost.

Further, in accordance with the structure made such that the fuel distribution path disposed along the line X—X in the direction of the longitudinal axis within the fuel distribution pipe is formed so as to be sectioned from the cooling water flow path by forming the fuel distribution path and the cooling water flow path formed in the fuel distribution pipe along the line X—X in the direction of the longitudinal axis by a drawing process and closing the fuel distribution path and the cooling water flow path respectively open to the one end portion and the another end portion of the fuel distribution pipe by the one side closing member and the another side closing member, it is possible to provide the fuel distribution pipe by a drawing process, whereby it is possible to reduce the producing cost.

Further, in accordance with the structure made such that the fuel distribution pipe is formed by a drawing process and the fuel introduction path connected to the fuel distribution path and the cooling water introduction path connected to the cooling water flow path are provided in the one side closing member, it is not necessary to provide the fuel introduction path and the cooling water introduction path in the fuel distribution pipe itself, and it is easy to form the fuel distribution pipe by a drawing process.

Further, in accordance with the structure made such that the fuel distribution pipe is formed by a drawing process and the fuel introduction path connected to the fuel distribution path and the cooling water introduction path and the cooling water discharge path connected to the cooling water flow path are provided in the one side closing member, it is more easy to form the fuel distribution pipe by a drawing process.

Further, in accordance with the structure made such that the fuel introduction path connected to the fuel distribution path and the cooling water introduction path connected to the cooling water flow path are provided in the one side closing member, and the cooling water discharge path connected to the cooling water flow path is provided in the another side closing member, it is possible to securely flow the cooling water within the cooling water flow path from the one side to the another side and it is possible to improve an effect of cooling the fuel within the fuel distribution path.

Further, in accordance with the structure made such that the heat radiating fins disposed along the line X—X in the direction of the longitudinal axis of the fuel distribution pipe are provided in any one or both of the outer peripheral wall of the fuel distribution path and the inner peripheral wall of the cooling water flow path, it is possible to increase an effect of radiating the heat of the fuel distribution pipe itself and the fuel distribution path, so that it is possible to further restrict an increase of temperature of the fuel.

Further, in accordance with the structure made such that the cooling water flow path is sectioned into the first cooling water flow path and the second cooling water flow path along the line X—X in the direction of the longitudinal axis by the partition wall, the first cooling water flow path and the second cooling water flow path are communicated by the another end portion of the fuel distribution pipe, the cooling water introduction path is opened to the first cooling water flow path open to the one end portion, and the cooling water discharge path is opened to the second cooling water flow path open to the one end portion, it is possible to U-turn the cooling water within the cooling water path so as to improve a cooling effect and it is possible to increase a rigidity of the fuel distribution pipe by the partition wall.

What is claimed is:

1. A fuel distribution pipe in a fuel injection apparatus which increase a pressure of a fuel within a fuel source by a fuel pump to supply to the fuel distribution pipe and inject and supply the fuel to an engine via a fuel injection valve attached to the fuel distribution pipe, characterized that the fuel distribution path is pierced along a line X—X in a direction of a longitudinal axis of the fuel distribution pipe and an injection valve supporting hole for inserting and supporting a rear end portion of the fuel injection valve and a fuel introduction path for supplying a fuel having a pressure increased by a fuel pump are continuously provided in said fuel distribution path of the fuel distribution pipe, and that a cooling water flow path extending along the line X—X in the direction of the longitudinal axis of the fuel distribution path and sectioned from the fuel distribution path is provided on an outer periphery of said fuel distribution path, thereby introducing a cooling water into said cooling water flow path;

wherein a cooling water introduction path and a cooling water discharge path are opened to said cooling water flow path, thereby circulating the cooling water within the cooling water flow path;

wherein the fuel distribution path and the cooling water flow path are formed within the fuel distribution pipe in a sectional manner by forming the fuel distribution path and the cooling water flow path formed in said fuel distribution pipe so as to be opened in one and portion by a casting process and closing said one end portion by one side closing member, and the fuel introduction path connected to the fuel distribution path and a cooling water introduction path connected to the cooling water flow path are provided in said one side closing member.

2. A fuel distribution pipe in a fuel injection apparatus which increase a pressure of a fuel within a fuel source by a fuel pump to supply to the fuel distribution pipe and inject and supply the fuel to an engine via a fuel injection valve attached to the fuel distribution pipe, characterized that the fuel distribution path is pierced along a line X—X in a direction of a longitudinal axis of the fuel distribution pipe and an injection valve supporting hole for inserting and supporting a rear end portion of the fuel injection valve and a fuel introduction path for supplying a fuel having a pressure increased by a fuel pump are continuously provided in said fuel distribution path of the fuel distribution pipe, and that a cooling water flow path extending along the line X—X in the direction of the longitudinal axis of the fuel distribution path and sectioned from the fuel distribution path is provided on an outer periphery of said fuel distribution path, thereby introducing a cooling water into said cooling water flow path;

wherein a cooling water introduction path and a cooling water discharge path are opened to said cooling water flow path, thereby circulating the cooling water within the cooling water flow path;

wherein the fuel distribution path and the cooling water flow path are formed within the fuel distribution pipe in a sectional manner by forming the fuel distribution path and the cooling water flow path formed in said fuel distribution pipe so as to be opened in one and portion by a casting process and closing said one end portion by one side closing member, and the fuel introduction path connected to the fuel distribution path and a cooling water introduction path connected to the cooling water flow path are provided in said one side closing member;

wherein the fuel introduction path connected to the fuel distribution path, the cooling water introduction path connected to the cooling water flow path and a cooling water discharge path are provided in said one side closing member.

3. A fuel distribution pipe in a fuel injection apparatus which increase a pressure of a fuel within a fuel source by a fuel pump to supply to the fuel distribution pipe and inject and supply the fuel to an engine via a fuel injection valve attached to the fuel distribution pipe, characterized that the fuel distribution path is pierced along a line X—X in a direction of a longitudinal axis of the fuel distribution pipe and an injection valve supporting hole for inserting and supporting a rear end portion of the fuel injection valve and a fuel introduction path for supplying a fuel having a pressure increased by a fuel pump are continuously provided in said fuel distribution path of the fuel distribution pipe, and that a cooling water flow path extending along the line X—X in the direction of the longitudinal axis of the fuel distribution path and sectioned from the fuel distribution path is provided on an outer periphery of said fuel distribution path, thereby introducing a cooling water into said cooling water flow path;

wherein the fuel distribution path disposed along the line X—X in the direction of the longitudinal axis within the fuel distribution pipe is formed so as to be sectioned from the cooling water flow path by forming the fuel distribution path and the cooling water flow path in said fuel distribution pipe by a drawing process along the line X—X in the direction of the longitudinal axis and closing the fuel distribution path and the cooling water flow path respectively open to one end portion and another end portion of the fuel distribution pipe by one side closing member and another side closing member;

wherein the fuel introduction path connected to the fuel distribution path and the cooling water introduction path connected to the cooling water flow path are provided in said one side closing member.

4. A fuel distribution pipe in a fuel injection apparatus which increase a pressure of a fuel within a fuel source by a fuel pump to supply to the fuel distribution pipe and inject and supply the fuel to an engine via a fuel injection valve attached to the fuel distribution pipe, characterized that the fuel distribution path is pierced along a line X—X in a direction of a longitudinal axis of the fuel distribution pipe and an injection valve supporting hole for inserting and supporting a rear end portion of the fuel injection valve and a fuel introduction path for supplying a fuel having a pressure increased by a fuel pump are continuously provided in said fuel distribution path of the fuel distribution pipe, and that a cooling water flow path extending along the line X—X in the direction of the longitudinal axis of the fuel distribution path and sectioned from the fuel distribution path is provided on an outer periphery of said fuel distribution path, thereby introducing a cooling water into said cooling water flow path;

wherein the fuel distribution path disposed along the line X—X in the direction of the longitudinal axis within the fuel distribution pipe is formed so as to be sectioned from the cooling water flow path by forming the fuel distribution path and the cooling water flow path in said fuel distribution pipe by a drafting process along the line X—X in the direction of the longitudinal axis and closing the fuel distribution path and the cooling water flow path respectively open to one end portion and another end portion of the fuel distribution pipe by one side closing member and another side closing member;

wherein the fuel introduction path connected to the fuel distribution path and the cooling water introduction path and the cooling water discharge path connected to the cooling water flow path are provided in said one side closing member.

5. A fuel distribution pipe in a fuel injection apparatus which increase a pressure of a fuel within a fuel source by a fuel pump to supply to the fuel distribution pipe and inject and supply the fuel to an engine via a fuel injection valve attached to the fuel distribution pipe, characterized that the fuel distribution path is pierced along a line X—X in a direction of a longitudinal axis of the fuel distribution pipe and an injection valve supporting hole for inserting and supporting a rear end portion of the fuel injection valve and a fuel introduction path for supplying a fuel having a pressure increased by a fuel pump are continuously provided in said fuel distribution path of the fuel distribution pipe, and that a cooling water flow path extending along the line X—X in the direction of the longitudinal axis of the fuel distribution path and sectioned from the fuel distribution path is provided on an outer periphery of said fuel distribution path thereby introducing a cooling water into said cooling water flow path;

wherein the fuel distribution path, disposed along the line X—X in the direction of the longitudinal axis within the fuel distribution pipe is formed so as to be sectioned from the cooling water flow path by forming the fuel distribution path and the cooling water flow path in said fuel distribution pipe by a drawing process along the line X—X in the direction of the longitudinal axis and closing the fuel distribution path and the cooling water flow path respectively open to one end portion and another end portion of the fuel distribution pipe by one side closing member and another side closing member;

wherein the fuel introduction path corrected to the fuel distribution path and the cooling water introduction path connected to the cooling water flow path are provided in said one side closing member, and the cooling water discharge path connected to the cooling water flow path is provided in said another side closing member.

6. A fuel distribution pipe in a fuel injection apparatus which increase a pressure of a fuel within a fuel source by a fuel pump to supply to the fuel distribution pipe and inject and supply the fuel to an engine via a fuel injection valve attached to the fuel distribution pipe, characterized that the fuel distribution path is pierced along a line X—X in a direction of a longitudinal axis of the fuel distribution pipe and an injection valve supporting hole for inserting and supporting a rear end portion of the fuel injection valve and a fuel introduction path for supplying a fuel having a pressure increased by a fuel pump arc continuously provided in said fuel distribution path of the fuel distribution pipe, and that a cooling water flow path extending along the line X—X in the direction of the longitudinal axis of the fuel distribution path and sectioned from the fuel distribution path is provided on an outer periphery of said fuel distribution path, thereby introducing a cooling water into said cooling water flow path;

wherein said cooling water flow path is sectioned into a first cooling water flow path and a second cooling water flow path along the line X—X in the direction of the longitudinal axis by a partition wall, said first cooling water flow path and said second cooling water flow path are communicated by another end portion of the fuel distribute on pipe, the cooling water introduction path is opened to the first cooling water flow path open to the one end portion, and the cooling water discharge path is opened to the second cooling water flow path open to the one end portion.

7. A fuel distribution pipe in a fuel injection apparatus, comprising:

said apparatus which increases pressure of a fuel within a fuel source by a fuel pump to supply to the fuel distribution pipe and inject and supply the fuel to an engine via a fuel injection valve attached to the fuel distribution pipe, characterized that a fuel distribution path formed in the fuel distribution pipe 1 and a cooling water flow path formed around the fuel distribution path open toward a bottom portion of a circular hole opening in a one end portion of the fuel distribution pipe; and that a one side closing member is provided with a large-diameter cylinder portion, a small-diameter cylinder portion protruding from a left end portion of the large-diameter cylinder portion to another side, a fuel introduction path opening in a left end portion of the small-diameter cylinder portion, a cooling water groove portion recessed in the large-diameter cylinder portion and opening in a left end portion, a cooling water introduction path formed in the large-diameter cylinder portion and communicating within the cooling water groove portion and a cooling water discharge path formed in the large-diameter cylinder portion and communicating within the cooling water groove portion; and that the small-diameter cylinder portion of the one side closing member is inserted and arranged in a liquid-tight manner within the fuel distribution path opening in the bottom portion of the circular hole, the large-diameter cylinder portion is inserted and arranged in a liquid-tight manner within the circular hole, the fuel introduction path provided in the one side closing member communicates with the fuel distribution path and the cooling water groove portion provided in the one side closing member communicates with the cooling water flow path.

8. A fuel distribution pipe in a fuel injection apparatus, comprising:

said apparatus which increases pressure of a fuel within a fuel source by a fuel pump to supply to the fuel distribution pipe and inject and supply the fuel to an engine via a fuel ejection valve attached to the fuel distribution pipe, wherein a fuel distribution path formed in a fuel distribution pipe and a cooling water flow path formed around the fuel distribution path open toward a bottom portion of a circular hole opening in a first end portion of the fuel distribution pipe and a bottom portion of a circular hole opening in a second end portion; and wherein a first side closing member is provided with a large-diameter cylinder portion, a small-diameter cylinder portion protruding from a left end portion of the large-diameter cylinder portion to another side, a fuel introduction path opening in a left end portion of the small-diameter cylinder portion, a cooling water groove portion recessed in the large-diameter cylinder portion and opening in the left end portion and a cooling water introduction path formed in the large diameter cylinder portion and communicating within the cooling water groove portion; and wherein a second side closing member is provided with a large-diameter cylinder portion, a small-diameter cylinder portion protruding from a right end portion of the large-diameter cylinder portion to one side, a cooling water groove portion recessed in the large-diameter cylinder portion and opening in the right end portion, and a cooling water discharge path formed in the large-diameter cylinder portion and communicating within the cooling water groove portion; and wherein the small-diameter cylinder portion of the first side closing member is inserted and arranged in a liquid-tight manner within the fuel distribution path opening in the bottom portion of the circular hole, the large-diameter cylinder portion is inserted and arranged in a liquid-tight manner within the circular hole, the fuel introduction path provided in the first side closing member communicates with the fuel distribution path, the cooling water groove portion provided in the first side closing member communicates with the cooling water flow path, the small-diameter cylinder portion of the second side closing member is inserted and arranged in a liquid-tight manner within the fuel distribution path opening in the bottom portion of the circular hole, the large-diameter cylinder portion is inserted and arranged in a liquid-tight manner within the circular hole and the cooling water groove portion communicates with the cooling water flow path.

9. A fuel distribution pipe in a fuel injection apparatus, comprising:

said apparatus which increases pressure of a fuel within a fuel source by a fuel pump to supply to the fuel distribution pipe and inject and supply the fuel to an engine via a fuel injection valve attached to the fuel distribution pipe, wherein a fuel distribution path formed in a fuel distribution pipe and a first cooling water flow path and a second cooling water flow path formed around the fuel distribution path and formed sectionally each other open toward a bottom portion of a circular hole opening in a first end portion of the fuel distribution pipe and a bottom portion of a circular hole opening in a second end portion; and wherein a first side closing member is provided with a large-diameter cylinder portion, a small-diameter cylinder portion protruding from a left end portion of the large-diameter cylinder portion to another side, a fuel introduction path opening in a left end portion of the small-diameter cylinder portion, a first cooling water groove portion and a second cooling water groove portion recessed in the large-diameter cylinder portion and opening in the left end portion sectionally each other, a cooling water introduction path formed in the large-diameter cylinder portion and communicating within the first cooling water groove portion and a cooling water discharge path formed in the large-diameter cylinder portion and communicating within the second cooling water groove portion; and wherein a second side closing member is provided with a large-diameter cylinder portion, a small-diameter cylinder portion protruding from a right end portion of the large-diameter cylinder portion to one side, a cooling water groove portion recessed in the large-diameter cylinder portion by which the first cooling water flow path and the second cooling water flow path opening sectionally to each other in the bottom portion of the circular hole communicate; and wherein the small-diameter cylinder portion of the one side closing member is inserted and arranged in a liquid-tight manner within the fuel distribution path opening in the bottom portion of the circular hole, the large-diameter cylinder portion is inserted and arranged in a liquid-tight manner within the circular hole, the fuel introduction path provided in the first side closing member communicates with the fuel distribution path, the first cooling water groove portion provided in the one side closing member communicates with the first cooling water flow path, the second cooling water groove portion communicates with the second cooling water flow path, the small-diameter cylinder portion of the second side closing member is inserted and arranged in a liquid-tight manner within the fuel distribution path opening in the bottom portion of the circular hole, the large-diameter cylinder portion is inserted and arranged in a liquid-tight manner within the circular hole, and the first cooling water flow path and the second cooling water flow path communicate by means of the cooling water groove portion provided in the second side closing member.

* * * * *

UNITED STATES PATENT AND TRADEMARK OFFICE

CERTIFICATE OF CORRECTION

PATENT NO. : 6,405,712 B1
DATED : June 18, 2002
INVENTOR(S) : Kenichi Nomura

It is certified that error appears in the above-identified patent and that said Letters Patent is hereby corrected as shown below:

Title page,
Item [30], Foreign Application Priority Data, delete "Mar. 12, 1999" and insert -- December 3, 1999 --.

Signed and Sealed this

Thirty-first Day of December, 2002

JAMES E. ROGAN
*Director of the United States Patent and Trademark Office*